US007459616B2

(12) United States Patent
Yoshisue

(10) Patent No.: US 7,459,616 B2
(45) Date of Patent: Dec. 2, 2008

(54) SHANK FLANGE FOR PIANO

(75) Inventor: Kenji Yoshisue, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/850,410

(22) Filed: May 21, 2004

(65) Prior Publication Data

US 2005/0045016 A1 Mar. 3, 2005

(30) Foreign Application Priority Data

Aug. 28, 2003 (JP) ..... 2003-304287

(51) Int. Cl.
*G10C 3/18* (2006.01)

(52) U.S. Cl. ..... 84/251

(58) Field of Classification Search ..... 84/170, 84/173, 174, 251, 234
See application file for complete search history.

(56) References Cited

U.S. PATENT DOCUMENTS 4,229,397 A * 10/1980 Fukuta et al. ..... 264/113
4,681,647 A 7/1987 Kondo et al.
4,849,037 A * 7/1989 Kondo et al. ..... 156/166
4,995,291 A * 2/1991 Takahashi ..... 84/237
5,880,043 A * 3/1999 Lorenz et al. ..... 442/94
6,051,307 A 4/2000 Kido et al.

FOREIGN PATENT DOCUMENTS

EP 0445647 A2 * 2/1991 ..... 84/237
JP 62-146194 9/1987
JP 2003015630 A * 1/2003

* cited by examiner

*Primary Examiner*—Kimberly R Lockett
(74) *Attorney, Agent, or Firm*—Crowell & Moring LLP

(57) ABSTRACT

A shank flange for use in a piano for supporting a hammer which makes a pivotal movement in response to depression on a key. The shank flange comprises a molding made of thermoplastic resin containing long fibers for reinforcement. The molding is molded by a long-staple method. The long fibers are carbon fibers. The shank flange excels in homogeneity and dimension stability, and has a high rigidity which can assure a smooth and stable action of the hammer. Also, dust and the like can be prevented from sticking to the shank flange and its surroundings, thus maintaining a precise action of the hammer and an aesthetically good appearance around the shank flange.

10 Claims, 2 Drawing Sheets

SHANK FLANGE FOR PIANO

BACKGROUND OF THE INVENTION

1. Field of the Invention

The present invention relates to a shank flange for use in an acoustic piano and the like for supporting a hammer which makes a pivotal movement in response to depression on an associated key of the piano.

2. Description of the Prior Art

FIG. 1 illustrates a hammer 20 and a shank flange 31 provided for each key 2 (see FIG. 3) in a grand piano. The hammer 30 comprises a hammer shank 32, a hammer head 33, and the like. The hammer shank 32 is formed of a wood material in an elongated rod shape, with the hammer head 33 disposed at a rear end thereof. The hammer shank 32 has two furcate arms 32*a* branching off in two at a front end thereof. The arms 32*a* extend forward in parallel with each other.

Conventionally, the shank flange 31 is generally made of a wood material. This is because the wood material has the advantage of being readily available, highly workable, and highly rigid though being light in weight. The shank flange 31 is fixed to a hammer shank rail 23 through a flange screw 38 (see FIG. 3). The shank flange 31 is formed with a protuberance 31*b* of a predetermined width which protrudes backward from a rear end thereof. The protuberance 31*b* is inserted between the two arms 32*a*. A pin 35 extends through the arms 32*a* and protuberance 31*b*, such that the hammer shank 32 is supported by the shank flange 31 through the pin 35 for pivotal movements about the horizontal axis.

The protuberance 31*b* of the shank flange 31 has both side surfaces formed in parallel with each other and opposing each other with a slight clearance between each side surface and the inner surface of the associated arm 32*a* of the hammer shank 32. A cylindrical shank roller 37 is attached at a front end of the bottom surface of the hammer shank 32. The hammer shank 32 is carried by a repetition lever 4 (see FIG. 3) of an action 1 through the shank roller 37.

In the foregoing structure, as the key 2 is depressed, the hammer shank 32 is pushed up by a jack 5 of the action 1 through the shank roller 37 to induce a pivotal movement of the hammer 30, causing the hammer head 33 to strike a string S, thereby generating associated sound from the piano (see FIG. 3). During the pivotal movement of the hammer 30, the hammer shank 32 is guided by the arms 32*a* and protuberance 31*b*, thus permitting the hammer 30 to make the pivotal movement without lateral oscillations.

Another known conventional shank flange is disclosed, for example, in Laid-open Japanese Utility Model Application No. 62-146194. This shank flange is designed to serve as a bat flange for pivotably supporting a bat of a hammer in an upright piano. The bat flange is made of an ABS resin instead of a wood material.

As mentioned above, the wood material has been conventionally used for the shank flange 31 in general because of the light weight and high rigidity provided by the wood material. Particularly, since the shank flange 31 functions to support the hammer 30, the shank flange 31 is required to be highly rigid such that the hammer 30 can make a stable pivotal movement even if the key 2 receives a hard blow. On the other hand, however, the wood material, which is a natural material, has the disadvantages of varying in rigidity and weight due to its poor homogeneity as well as of being susceptible to deformation such as bowing and twisting possibly caused by a residual stress. Also, since the wood material largely varies in dimensions depending on the humidity, the width of the protuberance 31*b* relatively largely expands or shrinks in response to the varying humidity when it is used for the shank flange 31 illustrated in FIG. 1. Particularly, in the shank flange 31, the clearances between the protuberance 31*b* and the arms 32*a* of the hammer shank 32 are originally set narrow, the expansion and shrinkage of the protuberance 31*b* due to the varying humidity cause the hammer shank 32 to be too loose or too tight with respect to the shank flange 31, resulting in a possible failure of a stable pivoting speed of the hammer 30 in response to a particular strength of depression on the key 2.

When the shank flange 31 is made of an ABS resin as disclosed in Laid-open Japanese Utility Model Application No. 62-146194, the resulting shank flange 31, though free from the aforementioned disadvantages involved in the wood material, tends to have an insufficient rigidity, as compared with the wood material, possibly failing to assure a satisfactorily stable action of the hammer 30 when the key 2 receives a hard blow. Also, the ABS resin, which has a larger specific gravity than the wood material, will cause an increase in the weight of the overall piano. In addition, since the ABS resin has a high electric insulating property, static electricity can be generated by friction between the hammer shank 32 and the shank flange 31, associated with the action of the hammer 30. The static electricity thus generated has no way to flow and tends to charge on the shank flange 31. The charge on the shank flange 31 would cause dust and the like to stick on the shank flange 31, possibly resulting in a defective action of the hammer 30, an aesthetically damaged appearance, and the like.

SUMMARY OF THE INVENTION

The present invention has been made to solve the problems as mentioned above, and it is an object of the invention to provide a shank flange for a piano which excels in homogeneity and dimension stability and has a high rigidity which can assure a smooth and stable action of a hammer.

To achieve the above object, the present invention provides a shank flange for use in a piano for supporting a hammer which makes a pivotal movement in response to depression, characterized in that the shank flange comprises a molding made of thermoplastic resin containing long fibers for reinforcement, and molded by a long-staple method.

The long-staple method used to mold the thermoplastic resin molding involves injection molding of a pellet including a fibrous reinforcement material coated with a thermoplastic resin and having the same length to produce the molding. With the long-staple method, the resulting molding contains relatively long fibrous reinforcement material having a length of 0.5 mm or more, by way of example. Thus, the shank flange of the present invention contains the relatively long reinforcement fibers which provide an extremely high rigidity as compared with a shank flange made only of a synthetic resin such as an ABS resin. This rigidity is equivalent to or even higher than that of a wood material. As a result, it is possible to limit distortion of the shank flange, when a key receives a hard blow, to stably support the hammer. Also, since the molding made by the long-staple method excels in homogeneity and dimension stability, as is the case with a molding made of a single synthetic resin, these properties can significantly limit deformation such as bowing and twisting of the shank flange itself, as well as expansion and shrinkage caused by the varying humidity as compared with the wood material. From the foregoing, a smooth and stable action can be assured for the hammer.

Preferably, in the shank flange for a piano, the long fibers are carbon fibers.

Generally, carbon fibers have a higher electric conductivity than other long fibers for reinforcement, for example, glass fibers. Therefore, with the employment of such carbon fibers as the long fibers for reinforcement, the shank flange can be improved in electric conductivity to prevent charging thereon. This results in prevention of dust and the like from sticking to the shank flange and its surroundings, thereby maintaining a precise action of the hammer and an aesthetically good appearance around the shank flange.

DETAILED DESCRIPTION OF THE PREFERRED EMBODIMENTS

In the following, a preferred embodiment of the present invention will be described in detail with reference to the accompanying drawings. It should be first noted that the following description will be made on the assumption that the front side (on the right-hand side in FIG. 3), when a grand piano is viewed from a player, is defined as "front"; the far side (on the left-hand side in FIG. 3) is defined as "rear"; and a direction in which keys 2 are arranged side by side is defined as a "lateral direction."

Figure 1:
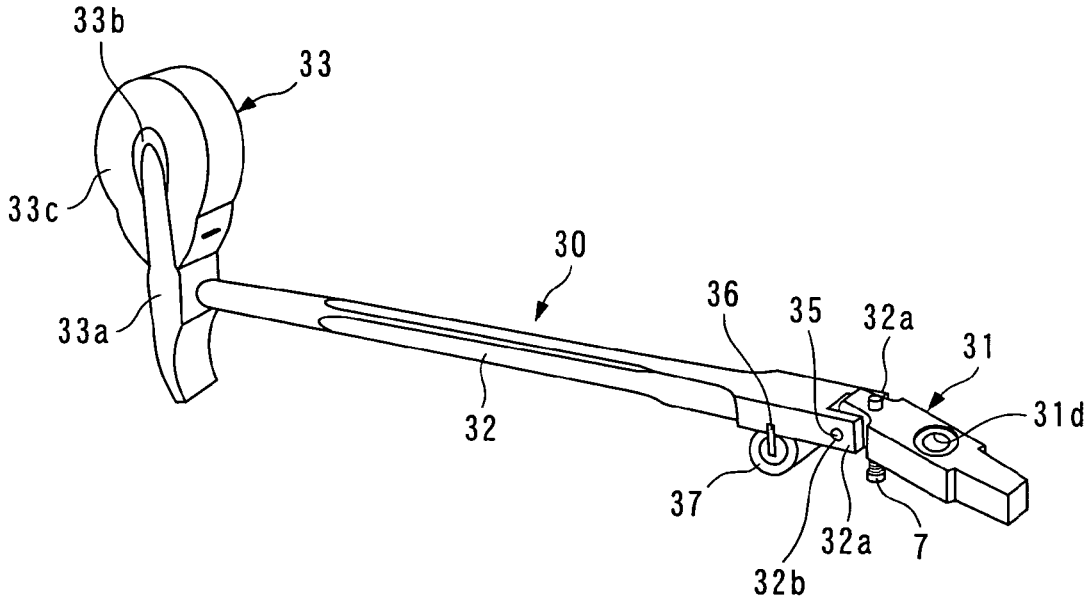
FIG. 1 is a perspective view illustrating a shank flange and a hammer for a grand piano according to one embodiment of the present invention.

First, the structure of the hammer 30 and shank flange 31 in a grand piano, which has been outlined above, will be described in greater detail with reference to FIGS. 1, 2A and 2B. A multiplicity of hammers 30 and shank flanges 31 are arranged side by side in the lateral direction corresponding to keys 2 associated thereto. Each hammer 30 comprises a hammer shank 32, a hammer head 33 attached to the rear end of the hammer shank 32, and the like.

The hammer head 33 comprises a wood-made hammer wood 33*a* oriented perpendicular to the hammer shank 32; and an under felt 33*b* and a top felt 33*c* wound in order to cover a leading end of the hammer wood 33*a*. The hammer shank 32 is made by cutting a wood material into a predetermined elongated rod shape. The hammer shank 32 is formed at its front end with a pair of arms 32*a* which extend forward in parallel with each other. The arms 32*a* are formed with holes 32*b* (only one of which is shown) extending side to side therethrough and arranged along a straight line. A pin 35 is inserted into these holes 32*b* through bushing cloth (not shown). A cylindrical shank roller 37 is attached on the bottom surface of the hammer shank 32 through a shank roller core 36 immediately behind the arms 32*a*.

In this embodiment, the shank flange 31 is made of a molding of a thermoplastic resin which is molded by a long staple method. For example, the shank flange 31 is made by injection molding using a pellet as described below. This pellet is made by aligning roving made of carbon fibers with a predetermined tension applied thereto, and covering the roving with a thermoplastic resin including a rubber-like copolymer, for example, an ABS resin extruded by an extruder. Such a making method can avoid broken carbon fiber roving during the formation of the pellet, and permit the resulting pellet to contain the carbon fibers having the same length. In this embodiment, the length of the pellet is set in a range of 5 to 15 mm, so that the shank flange 31, which is injection molded using the pellet, contains carbon fibers having a length in a range of 0.5 to 2 mm.

Figure 2A:
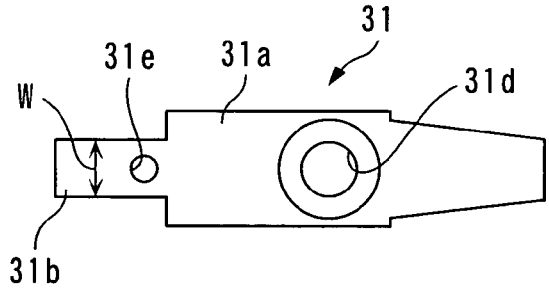
FIGS. 2A and 2B are a top plan view and a lateral view of the shank flange illustrated in FIG. 1, respectively.
Figure 2B:
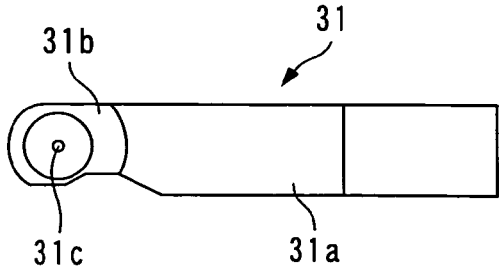

As illustrated in FIGS. 2A, 2B, the shank flange 31 comprises an elongated body 31*a* having a substantially rectangular cross-section; and a protuberance 31*b*, formed integrally with the shank flange 31, which protrudes backward from a central portion on a back surface of the body 31*a*. The protuberance 31*b* has a predetermined width W and both side surfaces formed in parallel with each other, such that protuberance 31*b* is inserted between the arms 32*a* of the hammer shank 32 with slight clearances on both sides. The protuberance 31*b* is formed with a hole 31*c* which extends side to side therethrough. Then, with a pin 35 inserted through the hole 31*c*, the hammer shank 32 is supported by the shank flange 31 through the pin 35 for pivotal movements about the horizontal axis.

An attachment hole 31*d* is formed extending vertically through a central portion of the body 31*a* for attaching the shank flange 31 to a hammer shank rail 23, later described. The protuberance 31*b* is further formed at a proximal end thereof with a screw hole 31*e* extending therethrough in the vertical direction. A drop screw 7 is vertically movably screwed into the screw hole 31*e* from below in order to limit upward pivotal movements of a repetition lever 4, later described.

Next, the structure of the action 1 for generating a pivotal movement of the hammer 30 in response to depression on the key 2 will be described with reference to FIG. 3. As illustrated, the action 1 comprises a pivotable wippen 3 extending in the longitudinal direction; the repetition lever 4 pivotably attached to the wippen 3; and a jack 5. The action 1 is attached between a left and a right bracket 21 (only one of which is shown). The left and right brackets 21 are fixed to a key frame (not shown) which carries the keys 2. A wippen rail 22 is extended between the two brackets 21, and the rear end of the wippen 3 is pivotably attached to each wippen flange 24 screwed on the wippen rail 22. Each wippen 3 rests on a capstan button 25, disposed in a rear portion on the top surface of the corresponding key 2, through a wippen heel 26.

A hammer shank rail 23 is extended between the left and right brackets 21. The hammer shank rail 23 is formed with a multiplicity of screw holes (not shown) arranged side by side in the lateral direction. The shank flange 31 is fixed to the hammer shank rail 23 by tightly screwing a flange screw 38 inserted through the attachment hole 31*d* thereof into the screw hole of the hammer shank rail 23.

The repetition lever 4, which is rectangular in cross-section, extends obliquely upward from rear to front in the longitudinal direction, and is pivotably attached to the wippen 3 in a central portion thereof. A lever screw 27 is screwed vertically through a rear end portion of the repetition lever 4 in such a manner that the lever screw 27 can move up and down. A lever button 28 is formed integrally with the lever screw 27 at the lower end thereof. The repetition lever 4 is also urged by a repetition spring 6 attached to the wippen 3 in a return direction (counter-clockwise direction in FIG. 3). In the foregoing structure, when the key 2 is not applied with a depressing force, the repetition lever 4 stays on the return side by a spring force of the repetition spring 6, and the lever button 28 is in abutment to the top surface of the wippen 3. In this event, the angle of the repetition lever 4 in a key released state can be adjusted by rotating the lever screw 27.

A jack guide hole 5*a* is formed vertically through the repetition lever 4 at a predetermined position in a front region of the repetition lever 4. The hammer 30 is carried on the top surface of the repetition lever 4 near a jack guide hole 4*a* through the shank roller 37. A lever skin 39 is also adhered in a front end portion on the top surface of the repetition lever 4, such that the lever skin 39 opposes the drop screw 7. With this structure, by rotating the drop screw 7 to adjust the amount by which the drop screw 7 protrudes downward, it is possible to adjust a let-off position at which the repetition lever 4 abuts to the drop screw 7.

The jack 5, which is formed in an L-shape, is made up of a hammer actuator 5*a* which extends in the vertical direction and is rectangular in cross-section; and a regulating button contact 5*b* which extends substantially at right angles backward from the lower end of hammer actuator 5*a*. The jack 5 is pivotably attached to the front end of the wippen 3 at the corner of the L-shape. The top end of the hammer actuator 5*a* is inserted into the jack guide hole 4*a* of the repetition lever 4 for movements in the longitudinal direction, and opposes the shank roller 37 with a slight spacing from the shank roller 37 in a key released state. The jack 5 is also urged in the return direction (counter-clockwise direction in FIG. 3) by the repetition spring 6 for urging the repetition lever 4.

A jack button screw 9 for adjusting the angular position of the jack 5 is screwed through an intermediate region of the hammer actuator 5*a* of the jack 5 in the longitudinal direction in such a manner that the jack button screw 9 can move front and back. A jack button 12 is disposed integrally with the leading end of the jack button screw 9. The jack button 12 is in abutment to a spoon 13 implanted on the wippen 3 in a key released state. Therefore, by rotating the jack button screw 9, the angular position of the jack 5 can be adjusted in the key released state.

A regulating rail 4 is fixed by screws on the bottom surface of the hammer shank rail 23. The regulating button 8 is screwed into the bottom surface of the regulating rail 40 for upward and downward movements for limiting upward pivotal movements of the jack 5. The regulating button 8 opposes the front end of the regulating button contact 5*b* of the jack 5 with a predetermined spacing therebetween.

Figure 3:
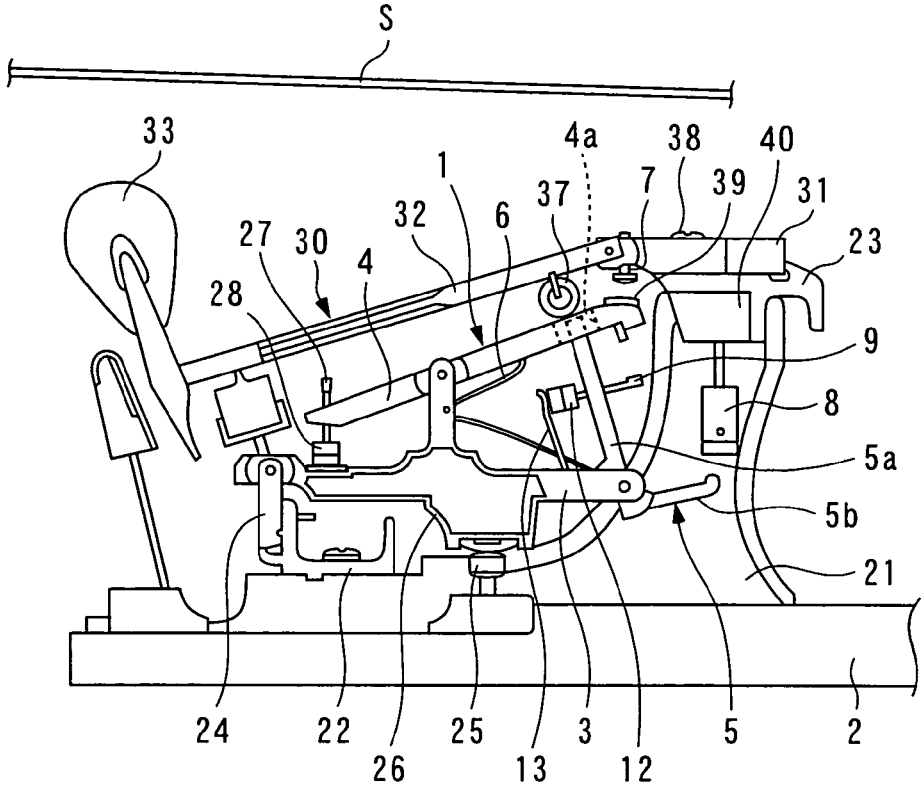
FIG. 3 is a lateral view of a keyboard device for a grand piano which includes the hammer and shank flange.

According to the action 1 structured as described above, as the key 2 is depressed in the key released state illustrated in FIG. 3, the wippen 3 is pushed up through the capstan button 25 to produce an upward pivotal movement, accompanied by pivotal movements of the repetition lever 4 and jack 5 attached to the wippen 3. In response, the repetition lever 4 first slides the shank roller 37 and simultaneously pushes up the hammer 30 through the shank roller 37, causing the hammer 30 to make a pivotal movement. Next, the repetition lever 4 is brought into engagement with the drop screw 7 to stop its pivotal movement, causing the jack 5 to push up the hammer 30 through the shank roller 37. Subsequently, at the time the hammer 30 has pivotally moved until immediately before it strikes the string S stretched above, the jack 5 is brought into engagement with the regulating button 8 to stop its pivotal movement, causing the jack 5 to come off the shank roller 37. Consequently, the hammer 30 is released from the coupling with the action 1 and key 2, and strikes the string S in a freely pivotable way.

As described above, according to the foregoing embodiment, the shank flange 31 for supporting the hammer 30 is made of an ABS resin molding molded by a long-staple method, and contains relatively long carbon fibers in a range of 0.5 to 2 mm as reinforcement long fibers. Thus, the resulting shank flange 31 provides an extremely high rigidity equivalent to or even higher than that of the wood material. As a result, the shank flange 31 can limit distortion thereof when the key 2 receives a hard blow, and stably support the hammer 30. Also, similar to a single synthetic resin, the excellence of the ABS resin in homogeneity and dimension stability can significantly limit deformation of shank flange 31 itself such as bowing and twisting, as well as expansion and shrinkage caused by the varying humidity, as compared with the wood material. Consequently, it is possible to prevent the hammer shank 32 from being too loose or too tight with respect to the shank flange 31 to assure a stable pivoting speed of the hammer 30 in response to a particular strength of depressing the key 2. From the foregoing, a smooth and stable action can be assured for the hammer 30.

Also, since the shank flange 31 of the foregoing embodiment employs carbon fibers for reinforcement long fibers, the shank flange 31 is improved in the electric conductivity to prevent a charge thereon. Accordingly, dust and the like can be prevented from sticking to the shank flange 31 and its surroundings, thereby maintaining a precise action of the hammer 30 and a good aesthetic appearance around the shank flange 31.

Figure 4:
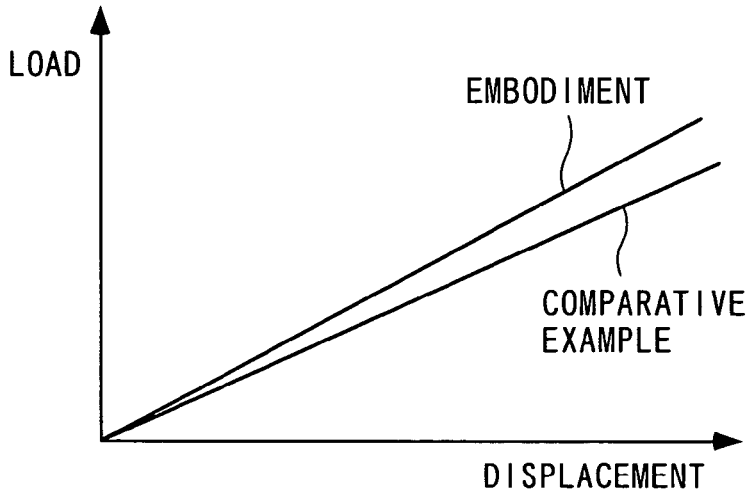
FIG. 4 is a graph showing the result of a rigidity test which was made on the shank flange and a comparative example.

FIG. 4 is a graph showing the result of a rigidity test which was made on the shank flange and a comparative example for confirming the effect of increasing the rigidity of the shank flange 31 according to the foregoing embodiment. A shank flange employed as a comparative example is made of a wood material (hornbeam) and has the same size and shape as the shank flange 31. For the test, the wippen rail 22, hammer shank rail 23, and regulating rail 40 are extended between the fixed brackets 21, and fixed for use as a testing stand. The shank flange 31 was fixed to the hammer shank rail 23 with the flange screw 38, and a load was applied to the protuberance 31*b* from above. In this state, a displacement of the protuberance 31*b* was measured, and the rigidity was calculated from the relationship between the load and displacement. The same number of samples were prepared for both the foregoing embodiment and comparative example. FIG. 4 shows an average relationship between the load and displacement for the embodiment and comparative example.

It can be appreciated from the result of the test that the shank flange 31 of the foregoing embodiment has the rigidity increased approximately by 15% from the comparative example, which is a rigidity much higher than the shank flange made of wood. Also, though not shown, it was confirmed that the embodiment exhibited less variations in rigidity among samples.

It should be understood that the present invention is not limited to the embodiment described above, but can be practiced in various manners. For example, while the foregoing embodiment employs an ABS resin for a thermoplastic resin and carbon fibers for reinforcement fibers by way of example, any other suitable materials may be employed instead. For example, glass fibers may be employed for the reinforcement fibers. Also, while the foregoing embodiment has been described for an example in which the present invention is applied to the shank flange for a grand piano, the present invention can be applied to a shank flange for any other type of piano having hammers, for example, a grand-type electronic piano, an automatically playable piano, and the like, as well as to a bat flange for an upright piano, and the like, as a matter of course. Otherwise, the present invention can be modified in detailed structure as required without departing from the spirit and scope of the invention as defined by the appended claims.

What is claimed is:

1. A shank flange for use in a piano for supporting a hammer which makes a pivotal movement in response to depression on a key, said shank flange comprising:

a molding made of thermoplastic resin containing long fibers for reinforcement, said molding comprising an injection molded pellet that is coated with a thermoplastic resin and contains a fibrous reinforcing material containing fibers having a same length as a length of the pellet.

2. A shank flange for a piano according to claim 1, wherein said long fibers are carbon fibers.

3. A shank flange for a piano according to claim 1, wherein said pellet includes a roving made of carbon fibers with a predetermined tension applied thereto.

4. A shank flange for a piano according to claim 1, in combination with a hammer shank, wherein the hammer shank includes a pair of arms that extend parallel to each other, wherein the shank flange includes a protuberance, and wherein the protuberance of the shank flange is disposed within the pair of arms of the hammer shank.

5. A shank flange for a piano according to claim 4, wherein the protuberance and the pair of arms are pivotably coupled together.

6. A shank flange for a piano according to claim 5, in further combination with a hammer shank rail, wherein the hammer shank rail is fixed to the shank flange.

7. A method for manufacturing a shank flange for use in a piano for supporting a hammer which makes a pivotal movement in response to depression on a key, comprising the steps of:

molding the shank flange by injection molding of a pellet that is coated with a thermoplastic resin and contains a fibrous reinforcing material containing fibers having a same length as a length of the pellet.

8. The method according to claim 7, further comprising the step of applying a tension to the fibers.

9. The method according to claim 7, further comprising the step of making the pellet by aligning a roving made of carbon fibers with a predetermined tension applied thereto.

10. The method according to claim 7, wherein the fibers are carbon fibers.

* * * * *